US005268665A

United States Patent [19]

Iwao

[11] Patent Number: 5,268,665

[45] Date of Patent: Dec. 7, 1993

[54] RESISTOR DEVICE FOR BLOWER MOTOR

[75] Inventor: Murakami Iwao, Gifu, Japan

[73] Assignee: Pacific Engineering Co., Ltd., Ogaki, Japan

[21] Appl. No.: 797,737

[22] Filed: Nov. 20, 1991

[30] Foreign Application Priority Data

Nov. 26, 1990 [JP] Japan ..... 2-324952
Mar. 30, 1991 [JP] Japan ..... 3-142284

[51] Int. Cl.[5] ..... H01C 7/10

[52] U.S. Cl. ..... 338/22 R; 338/50; 338/51; 338/220

[58] Field of Search ..... 338/22 R, 50, 225 D, 338/51, 220

[56] References Cited

U.S. PATENT DOCUMENTS 3,691,503 9/1972 Battle et al. .
4,408,244 10/1983 Weible ..... 338/220 X
4,935,717 6/1990 Osawa et al. ..... 338/51

FOREIGN PATENT DOCUMENTS 036319 4/1990 European Pat. Off. .
2348614 11/1977 France .
2392521 12/1978 France .
189360 8/1992 Taiwan .

*Primary Examiner*—Marvin M. Lateef
*Attorney, Agent, or Firm*—David G. Conlin; Robert F. O'Connell

[57] ABSTRACT

A resistor device for blower motor comprising one plate of PTC element having two side surfaces and a plurality of electrodes disposed on at least one of the two side surfaces. A plurality of different resistance values can be obtained from the one plate of PTC element, which makes it possible to realize a small and compact structure for the resistor device.

20 Claims, 4 Drawing Sheets

RESISTOR DEVICE FOR BLOWER MOTOR

BACKGROUND OF THE INVENTION

1. Field of the Invention

The present invention relates to a resistor device for controlling rotational speed of a blower motor used for an air conditioning system, for instance, installed in an automobile.

2. Description of the Related Art

The resistor device mentioned above is disposed around an outlet of an blower of an air conditioning system of an automobile so that the resistor device is cooled by the wind from the blower.

The resistor device of the kind is disclosed in Japanese Patent Publications (KOKOKU) No.57-45041 and No.57-32482 in which a semiconductor element of positive temperature coefficient (referred to as PTC element hereinafter) is used as the resistor element of the device. The PTC element has such a characteristic, as widely known, that the resistance thereof rises abruptly and greatly when the ambient temperature exceeds a predetermined value Curie temperature). As a result, when PTC element is not appropriately cooled when the current is applied thereto or when an excessive current over an allowable extent is applied to PTC element, the temperature of the PTC element is raised gradually first and when the temperature reaches Curie temperature, the resistance of the element increases suddenly very large so that the current is controlled and the temperature is maintained below the Curie temperature. Accordingly, the PTC element is very useful for proper operation of the motor and avoiding fire of the automobile.

However, according to the above mentioned Japanese patent publications (57-45041 and 57-32482) aiming at the safety structure for the motor and vehicle, the resistor device is arranged in such a manner that a plurality of ring-shaped PTC element plates and a plurality of terminal plates having a center hole are disposed alternately and combined together by bolt inserted through the center holes of the plates and secured together by a nut screwed on the bolt. In this structure, it becomes necessary to dispose an insulation spacer between the bolt and the terminal plates to avoid contact and the short circuit between the bolt and the terminal plates. As a result, the structure becomes complicated and proper adjustment of the torque for fastening the nut is necessitated, which makes the assembling work troublesome and the cost of the device becomes high.

SUMMARY OF THE INVENTION

The present invention was made considering the above mentioned problems of the related art.

It is therefore an object of the present invention to provide a resistor device for blower motor wherein the number of parts is reduced and the resistance against the wind from the blower is decreased, which makes it possible to simplify the structure and raise the reliability of the device.

Another object of the present invention is to provide a resistor device for blower motor wherein the productivity of the device is raised and the treatment and maintenance of the device can be conveniently conducted.

Also, it is required that the structure of the resistor device be compact so as to reduce the airflow loss of the blower as possible for a given capacity.

Still another object of the present invention is to provide a resistor device for blower motor which satisfies the requirement mentioned above.

The above mentioned objects can be achieved by a resistor device for blower motor comprising:

one plate of PTC element having two side surfaces; and a plurality of electrodes disposed on at least one of the two side surfaces.

In accordance with an embodiment of the resistor device for blower motor according to the present invention, it is desirable that a terminal plate unit comprising a plurality of electrode members be disposed to face to the electrodes of the PTC element plate, each of the electrode members being electrically separated from the other members and having a lead terminal portion.

In accordance with another embodiment of the resistor device for blower motor according to the present invention, it is desirable that each of the electrode members of the terminal plate unit be formed corresponding to each of the electrodes of the PTC element plate.

In accordance with still another embodiment of the resistor device for blower motor according to the present invention, it is desirable that the terminal plate unit include an electrode member spanning between a plurality of the electrodes of the PTC element plate.

In accordance with a further embodiment of the resistor device for blower motor according to the present invention, it is desirable that only one electrode be disposed on the other side surface of said PTC element plate covering almost entire area of the other side surface.

In accordance with a still further embodiment of the resistor device for blower motor according to the present invention, it is desirable that a plurality of electrodes be also disposed on the other side surface of the PTC element plate.

In accordance with a still further embodiment of the resistor device for blower motor according to the present invention, it is desirable that electrodes be disposed in only one of the side surfaces of the PTC element plate.

In accordance with a still further embodiment of the resistor device for blower motor according to the present invention, it is desirable that the PTC element plate and the terminal plate unit be held and secured together with the use of an elastic clip means.

In accordance with a still further embodiment of the resistor device for blower motor according to the present invention, it is desirable that the electrode member of the terminal plate unit have a lead terminal portion protruding therefrom.

In accordance with a still further embodiment of the resistor device for blower motor according to the present invention, it is desirable that the PTC element plate and the terminal plate unit be installed in a base holder unit in a state being combined together and pressed against each other by inserting the protruding lead terminal portions into through-holes formed in the base holder unit.

In accordance with a still further embodiment of the resistor device for blower motor according to the present invention, it is desirable that a small projection for engagement be formed on a lateral side of each protruding lead terminal portion to prevent the lead terminal portion from slipping out from the through-hole.

In accordance with the arrangement of the present invention mentioned above, the resistor device is constructed in such a manner that on at least one of the side surfaces of one PTC plate, a plurality of electrodes, each having a desired electric resistance, are formed and that a plurality of electrode members of terminal plates are pressingly abutted against the electrodes of the PTC plate. Therefore, only one PTC plate is needed to form the resistor device wherein the PTC plate is sandwiched by terminal plates from the both sides thereof, which makes it possible to realize a resistor device having a regular thickness irrespective of the number of electrodes of the PTC element.

Therefore, it is an advantage of the present invention that the structure becomes compact as a whole so that the airflow loss is reduced and the current capacity is increased according as the cooling effect is promoted.

Also, it is another advantage of the present invention that the structure of the base holder for assembling the sandwiched structure of the PTC element can be also simplified so that the number of the parts can be reduced and the device can be assembled easily and reliably.

Also, the number of the resistance value obtained from the resistor device is the total number of combination from any two of the terminals. For example, if there are four electrode terminals, six kinds of resistance can be obtained from the resistor device. Thus, so many different resistance values can be obtained from one simple structure of the device of the present invention, which raises the industrial applicability of the resistor device.

It is to be noted that the term terminal plate used in the present invention includes not only the plate which itself is made from a conductive member such as metal constituting an electrode itself but also a structure comprising an electric insulation plate having metal electrodes formed thereon as well.

Further objects and advantages of the present invention will be apparent from the following description of the preferred embodiments of the invention as illustrated in the accompanying drawings.

DESCRIPTION OF THE PREFERRED EMBODIMENTS

Figure 1A:
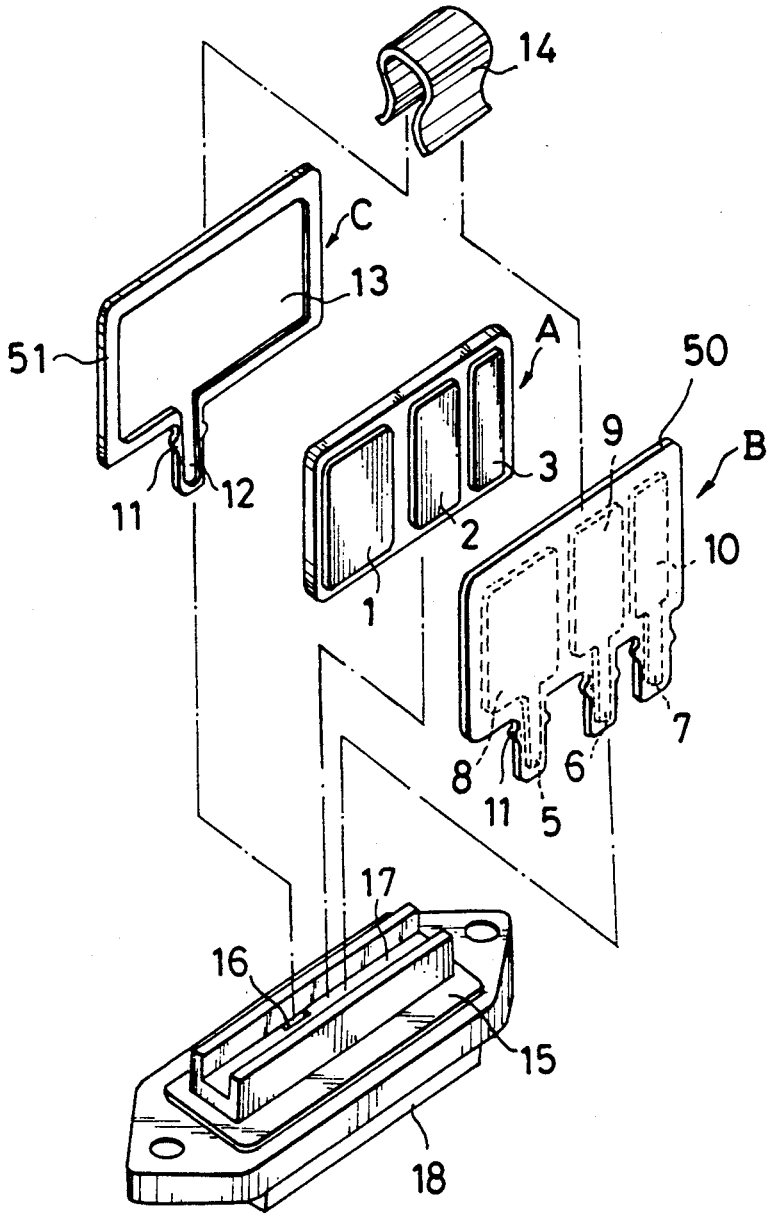
FIG. 1*a* is an exploded perspective view of the resistor device in accordance with an embodiment of the present invention.
Figure 1B:
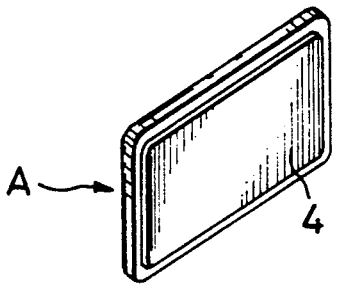
FIG. 1*b* is a perspective view of the PTC element of the device of FIG. 1*a* seen from the back side of the element.
Figure 2:
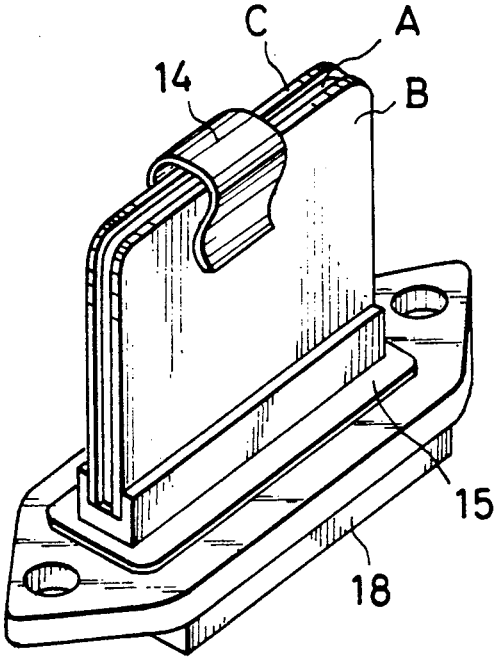
FIG. 2 is a perspective view of an assembly of the resistor device in accordance with the present invention.

FIGS. 1 and 2 illustrate an embodiment of the resistor device in accordance with the present invention wherein electrodes are disposed and attached to both sides of one plate of a PTC element. Reference A in the drawings designates a plate of a PTC element having two side surfaces (front side and back side). On one of the side surfaces, which is the front side surface in this particular drawing, a plurality of electrodes 1,2 and 3 are disposed. Each electrode has a size corresponding to a desired resistance value. On the other side of the PTC plate A (back side surface), one electrode 4 is disposed, as illustrated in FIG. 1*b*.

The PTC element is made from a ceramic member composed of $BaTiO_3$ or compound comprising $BaTiO_3$ or the component elements of the compound or the compound of the same group or series of $BaTiO_3$ or other ceramic or plastic members.

Reference B in FIG. 1*a* designates a terminal plate comprising an electric insulation plate 50 having terminal portions 5, 6 and 7 protruding from the lower edge thereof and electrode members 8, 9 and 10 disposed on one side surface of the insulation plate 50. The electrode members 8, 9 and 10 have sizes corresponding to the sizes of the electrodes 1, 2 and 3 of the PTC element, respectively. The electrodes 8, 9 and 10 extend into the protruding terminal portions 5, 6 and 7 of the plate 50, respectively. A small projection 11 for engagement is formed on each lateral side of each of the terminal portions 5, 6 and 7.

Reference C in FIG. 1*a* designates a terminal plate comprising an electric insulation plate 51 having a terminal portion 12 protruding from the lower edge thereof and an electrode member 13 disposed on one side surface of the insulation plate 51. The electrode member 13 has a size corresponding to the size of the electrode 4 of the PTC element A (FIG. 1*b*). The electrode 13 is formed extending into the protruding terminal portion 12 of the insulation plate 51. The terminal protrusion 12 has a small projection 11 on each of lateral sides thereof.

In accordance with the present invention, the PTC element A is sandwiched between the terminal plates B and C in such a way that the electrode members 8, 9 and 10 of the terminal plate B abut against the electrodes 1, 2 and 3 of the PTC element A, respectively and that the electrode 13 of the terminal plate C abuts against the terminal 4 of the PTC element A. The sandwich structure is held and secured by a elastic clip 14 and installed in a base holder 15.

The base holder 15 has a guide groove 17 into which the sandwich structure of the PTC element A interposed between the insulation plates B and C is inserted. In the bottom of the groove 17, through-holes 16 are formed at positions corresponding to the protruding terminals 5, 6, 7 and 12 of the terminal plates B and C, respectively. Only one through-hole 16 for the terminal 12 of the plate C is illustrated in FIG. 1*a*. The terminal protrusions 5, 6, 7 and 12 are inserted to the corresponding through-holes 16 and penetrate through the base holder 15 and project below the base holder 15. The holder 15 has a connector housing 18 formed underside thereof to surround the terminals 5, 6, 7 and 12 projecting below the base holder 15.

The sandwich structure is installed in the base holder 15 and secured thereto by pressingly inserting the protruding terminals into the through-holes 16 of the guide groove 17 whereby the small projections 11 of each terminal intrude into the inner surface of the through-hole to prevent the terminal protrusions from slipping out from the through-holes and avoid separation of the plates from the holder 15, thus making an assembled structure of the resistor device as illustrated in FIG. 2.

Figure 3A:
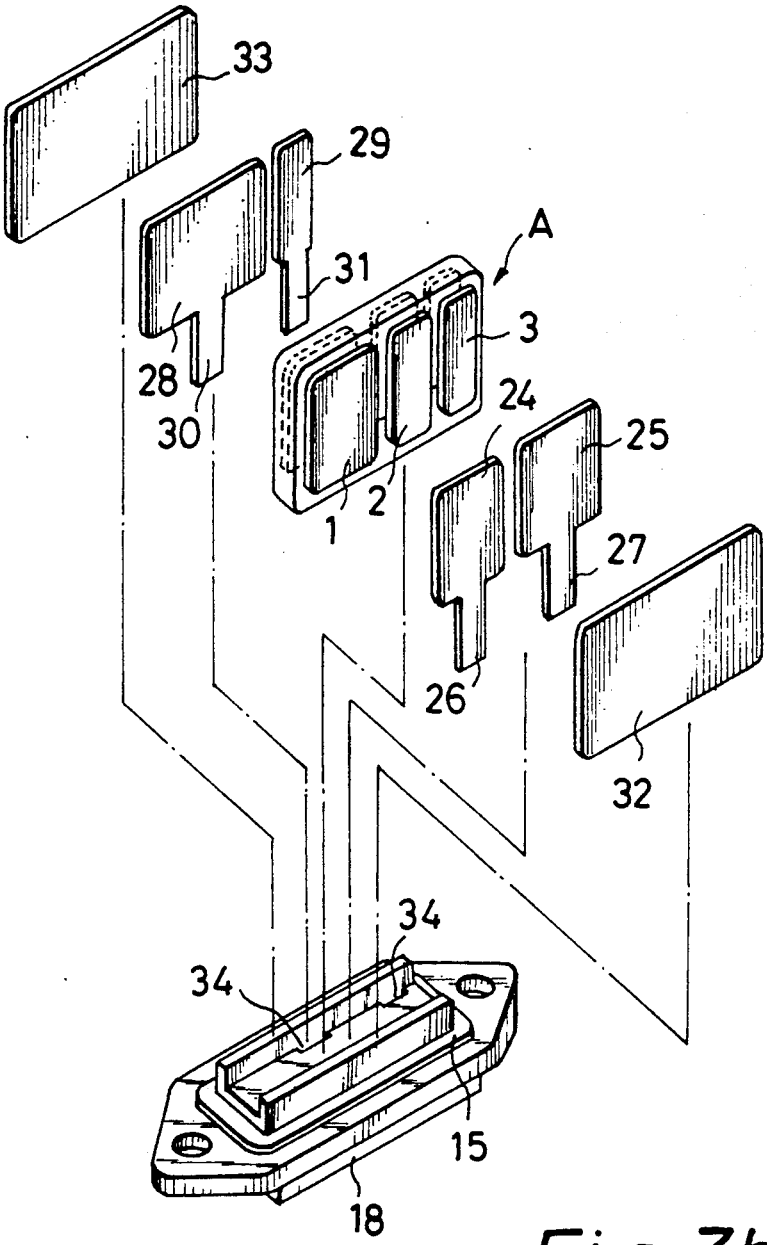
FIG. 3*a* is an exploded perspective view of the resistor device in accordance with another embodiment of the present invention.
Figure 3B:
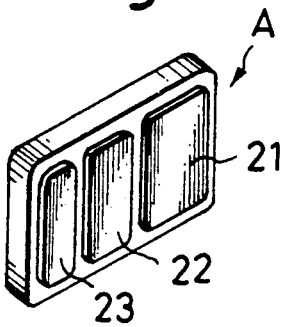
FIG. 3*b* is a perspective view of the PTC element of the device of FIG. 3*a* seen from the back side of the element.
Figure 4:
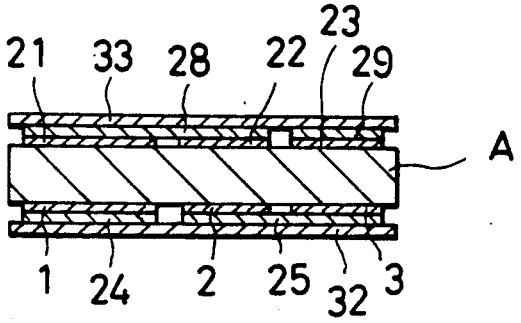
FIG. 4 is a sectional view of the center portion of the resistor device of FIG. 3.

FIGS. 3 and 4 illustrate another embodiment of the resistor device in accordance with the present invention. One plate of PTC element A has a plurality of electrodes 1, 2 and 3 formed on one side surface (front surface in this particular example), as illustrated in FIG. 3*a*. Each electrode has a size corresponding to a desired resistance value. Also, the PTC plate A has a plurality of electrodes 21, 22 and 23, each having a size corresponding to a desired resistance value, on the other side surface (back side surface) of the plate A, as illustrated in FIG. 3*b*.

Numerals 24 and 25 designate terminal plates, each constituting an electrode by itself and having a terminal 26, 27 projecting from the lower edge thereof. The terminal plate 24 is pressed against the electrode 1 of the PTC plate A. The terminal plate 25 spans over and between the electrodes 2 and 3 of the PTC plate A. The terminal plate 25 is pressed against the electrodes 2 and 3. The numerals 28 and 29 designate terminal plates, each constituting an electrode by itself and having a terminal 30, 31 projecting from the lower edge thereof. The terminal plate 28 is pressed against the two adjacent electrodes 21 and 22 formed on the backside of the PTC element A. Also, the terminal plate 29 is pressed against the electrode 23 formed on the backside of the PTC element A.

The terminal plates are pressed against the electrodes of the PTC element by any appropriate means. For example, insulation plates 32 and 33 are disposed in the outside of the terminal plates from both sides of the PTC plate A, as illustrated in FIG. 3*a*, and the vertical layered sandwich structure is held and combined together by the same elastic clip 14 as used in the first embodiment mentioned above. The sandwich structure secured by the clip is installed in the base holder 15 in a same manner as the above mentioned first embodiment, that is, by inserting the protruding terminals 26, 27, 30 and 31 into the through-holes 34 of the base holder 15.

To avoid separation of the terminal plate from the base holder, small projections (not shown) may be formed on the lateral sides of the protruding terminal, as in the case of the first embodiment mentioned above. Or other appropriate means may be adopted to prevent the terminals from slipping out from the through-holes 34.

FIG. 4 illustrates a horizontal section of a central portion of the resistor device of FIG. 3, showing the contact relation between the PTC element A, electrodes of the element and the terminal plates. From the terminal plate 24 disposed in the left end of the front side of the PTC plate A to the terminal plate 29 disposed in the right end of the back side of the PTC plate A is connected in series through the PTC plate and the other terminal plates, that is, from terminal 24 through electrode 1, PTC A, electrode 21, terminal 28, electrode 22, PTC A, electrode 2, terminal 25, electrode 3, PTC A and electrode 23 to the terminal 29. By selecting any two terminals, various resistance values can be obtained between the two terminals.

Figure 5:
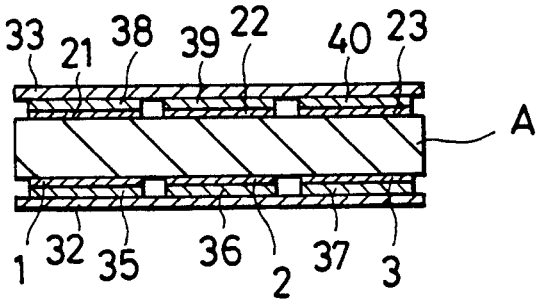
FIG. 5 is a sectional view of the center portion of still another embodiment of the resistor device in accordance with the present invention.

FIG. 5 illustrates a horizontal section of a central portion of still another embodiment of the resistor device in accordance with the present invention. In this embodiment, three electrodes 1, 2 and 3 are disposed on the front surface of the PTC plate A and three electrodes 21, 22 and 23 are also disposed on the back surface of the PTC plate A. The six electrodes of the PTC plate A are pressingly covered by six terminal plates 35 to 40, respectively.

Figure 6:
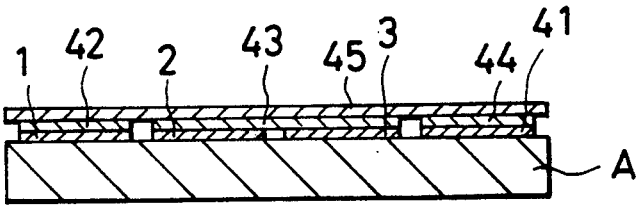
FIG. 6 is a sectional view of the center portion of further embodiment of the resistor device in accordance with the present invention.

FIG. 6 illustrates a horizontal section of a central portion of still another embodiment of the resistor device in accordance with the present invention. In this embodiment, four electrodes 1, 2, 3 and 41 are disposed on one side surface of a PTC element plate A. One terminal plate 43 is disposed spanning between the electrodes 2 and 3 and abuts against the two electrodes 2 and 3. Also, terminal plates 42 and 44 are disposed corresponding to the electrodes 1 and 41 and abut against the electrodes, respectively.

In the embodiment of FIG. 6, the terminal plate 43 covers the adjacent two electrodes 2 and 3. However, any two electrodes may be covered by one terminal plate. The two electrodes may not necessarily be adjacent to each other. Also, one terminal plate may cover three electrodes or more. Further, the number of the terminal plates is not limited to three which is the case of the particular embodiment of FIG. 6.

It is also to be noted that the number of the electrodes of the PTC plate is not limited to that of the first embodiment or the second embodiment wherein three electrodes are disposed in the front surface and one electrode is disposed in the back surface of the PTC plate in accordance with the first embodiment and three electrodes are disposed in each of the two surfaces of the PTC plate in accordance with the second embodiment.

Also, a plurality of electrodes may be arranged in only one side surface of the PTC plate and a terminal plate is disposed corresponding to each of the electrodes so that any two terminal plates are selected to obtain desired resistance values between the two terminal plates. Further, heat radiation fins may be arranged on the outer surface of the insulation plates or the terminal plates to enhance the cooling effect.

It is also to be noted that the shape of the PTC element is not limited to the rectangular shape. Any desired shape may be adopted according to the design condition, the characteristic to be obtained or spatial condition of the place to mount the device.

Many widely different embodiments of the present invention may be constructed without departing from the spirit and scope of the present invention. It should be understood that the present invention is not limited to the specific embodiments described in the specification, except as defined in the appended claims.

What is claimed is:

1. A resistor device for a blower motor comprising:

a PTC element plate having two side surfaces;

a plurality of electrodes disposed on at least one of said two side surfaces; and a terminal plate means having a plurality of electrode members, said electrode members being separated electrically from each other and each having a lead terminal portion, said terminal plate means facing said at least one surface of said PTC element plate in such a manner that said electrodes of said PTC element plate are in contact with said electrode members.

2. A resistor device for a blower motor according to claim 1 wherein each of said electrode members of said terminal plate means is formed so as to correspond to each of the electrodes of said PTC element plate.

3. A resistor device for a blower motor according to claim 1, wherein said terminal plate means includes an electrode member spanning over and between a plurality of said electrodes of said PTC element plate.

4. A resistor device for a blower motor according to claim 1, wherein only one electrode is disposed on the other side surface of said PTC element plate covering almost an area of the other side surface.

5. A resistor device for a blower motor according to claim 1, wherein a plurality of electrodes are also disposed on the other side surface of said PTC element plate.

6. A resistor device for a blower motor according to claim 1, wherein electrodes are disposed on only one of the side surfaces of said PTC element plate.

7. A resistor device for a blower motor according to claim 1 wherein said PTC element plate and said terminal plate means are held and secured together with the use of an elastic clip means.

8. A resistor device for a blower motor according to claim 1, wherein at least one of said electrode members of said terminal plate means has a lead terminal portion protruding therefrom.

9. A resistor device for a blower motor according to claim 9, wherein said PTC element plate and said terminal plate means are installed in a base holder means in a state of being combined together and pressed against each other by inserting said protruding lead terminal portions into through-holes formed in said base holder means.

10. A resistor device for a blower motor according to claim 9 wherein a small projection for engagement is formed on a lateral side of each protruding lead terminal portion to prevent said lead terminal portion from slipping out from said through hole.

11. A resistor device for a blower motor comprising:

a PTC element plate having two side surfaces;

a plurality of electrodes disposed on at least one of said two side surfaces; and a plurality of electrodes members being adapted to contact with said electrodes of said PTC element plate, said electrode members being electrically separated from each other, and each of said electrode members having a lead terminal portion.

12. A resistor device for a blower motor according to claim 11, wherein each of said electrode members is formed so as to correspond to each of said electrodes of said PTC element plate.

13. A resistor device for a blower motor according to claim 11, wherein at least one of said electrode members is formed so as to span over and between a plurality of said electrodes of said PTC element plate.

14. A resistor device for a blower motor according to claim 11, wherein only one electrode is disposed on the other side surface of said PTC element plate covering almost an entire area of the other side surface.

15. A resistor device for a blower motor according to claim 11, wherein a plurality of electrodes are also disposed on the other side surface of said PTC element plate.

16. A resistor device for a blower motor according to claim 11, wherein electrodes are disposed on only one side surfaces of said PTC element plate.

17. A resistor device for a blower motor according to claim 11 and further comprising an electric insulation plate, said PTC element plate and said electric insulation plate being held and secured together so that said electrode members are positioned between said PTC element plate and said electric insulation plate.

18. A resistor device for a blower motor according to claim 11, wherein each of said members has a lead terminal portion protruding therefrom.

19. A resistor device for a blower motor according to claim 18, wherein said PTC element plate and said electrode members are installed in a base holder means so as to be combined together and pressed against each other by inserting said protruding lead terminal portions into through-holes formed in said base holder means.

20. A resistor device for a blower motor according to claim 19, wherein a small projection for engagement is formed on a lateral side of each protruding lead terminal portion to prevent said terminal portion from slipping out from said through-hole.

* * * * *

UNITED STATES PATENT AND TRADEMARK OFFICE

CERTIFICATE OF CORRECTION

PATENT NO. : 5,268,665

DATED : December 7, 1993

INVENTOR(S) : Iwao

It is certified that error appears in the above-identified patent and that said Letters Patent is hereby corrected as shown below:

Col. 7, line 27, change "claim 9" to --claim 8--.

Signed and Sealed this

Twenty-first Day of June, 1994

Bruce Lehman

*Attest:*

BRUCE LEHMAN

*Attesting Officer*

*Commissioner of Patents and Trademarks*